US006793485B2

(12) United States Patent
Kayahara et al.

(10) Patent No.: US 6,793,485 B2
(45) Date of Patent: Sep. 21, 2004

(54) COMBUSTION APPARATUS FOR $NO_X$ REDUCTION

(75) Inventors: Toshihiro Kayahara, Matsuyama (JP); Hideo Furukawa, Matsuyama (JP); Tomohisa Takeda, Matsuyama (JP); Kanta Kondo, Matsuyama (JP)

(73) Assignee: Miura Co., Ltd., Matsuyama (JP)

( * ) Notice: Subject to any disclaimer, the term of this patent is extended or adjusted under 35 U.S.C. 154(b) by 0 days.

(21) Appl. No.: 10/622,460

(22) Filed: Jul. 21, 2003

(65) Prior Publication Data

US 2004/0106079 A1 Jun. 3, 2004

(30) Foreign Application Priority Data

Jul. 29, 2002 (JP) ..... 2002-219400
May 20, 2003 (JP) ..... 2003-141254

(51) Int. Cl.[7] ..... F23N 1/00
(52) U.S. Cl. ..... 431/89; 431/12
(58) Field of Search ..... 431/89, 12, 36

(56) References Cited

U.S. PATENT DOCUMENTS 5,067,419 A * 11/1991 Kobayashi et al. ..... 110/234
5,353,748 A 10/1994 Kayahara et al.
5,938,427 A * 8/1999 Suzuki et al. ..... 431/208
6,029,614 A 2/2000 Kayahara et al.
2004/0025805 A1 * 2/2004 Kayahara et al. ..... 122/235.11
2004/0072110 A1 * 4/2004 Kayahara et al. ..... 431/5

* cited by examiner

*Primary Examiner*—Alfred Basichas
(74) *Attorney, Agent, or Firm*—Birch, Stewart, Kolasch & Birch, LLP

(57) ABSTRACT

A combustion apparatus for $NO_x$ reduction and CO reduction capable of achieving stable $NO_x$ reduction with simple means. The combustion apparatus for fulfilling $NO_x$ reduction by controlling the temperature of combustion gas derived from a burner 1 includes $NO_x$ reduction means having an excess air ratio versus $NO_x$ characteristic that generated $NO_x$ value decreases with increasing excess air ratio of the burner 1, and an excess air ratio versus CO characteristic that exhaust CO value increases with increasing excess air ratio, and excess-air-ratio control means for controlling the excess air ratio of the burner 1 to a specified excess air ratio, wherein the excess-air-ratio control means includes outside-air temperature detection means 2 and controls the excess air ratio to the specified excess air ratio based on a detection signal derived from the outside-air temperature detection means 42.

4 Claims, 12 Drawing Sheets

COMBUSTION APPARATUS FOR $NO_X$ REDUCTION

BACKGROUND OF THE INVENTION

The present invention relates to a combustion apparatus for $NO_x$ reduction to be applied to water-tube boilers, reheaters of absorption refrigerators, or the like.

Generally, as the principle of suppression of $NO_x$ generation, there have been known (1) suppressing the temperature of flame (combustion gas), (2) reduction of residence time of high-temperature combustion gas, and (3) lowering the oxygen partial pressure. Then, various $NO_x$ reduction techniques to which these principles are applied are available. Examples that have been proposed and developed into practical use include the two-stage combustion method, the thick and thin fuel combustion method, the exhaust gas recirculate combustion method, the water addition combustion method, the steam jet combustion method, the flame cooling combustion method with water-tube groups, and the like.

With the progress of times, $NO_x$ generation sources even of relatively small capacity such as water-tube boilers have been coming under increasingly stricter regulation of exhaust gas, and so further reduction of $NO_x$ is demanded therefor. The present applicant proposed $NO_x$ reduction techniques for these demands by Japanese Patent Laid-Open Publication HEI 11-132404 (Specification of U.S. Pat. No. 6,029,614).

This prior art technique is intended to achieve $NO_x$ reduction by a combination of cooling of burning-reaction ongoing gas with water tubes and cooling of burning-reaction ongoing gas with exhaust gas recirculation. However, the technique was capable of $NO_x$ reduction up to only about 25 ppm, other than one that allows $NO_x$ reduction to below 10 ppm to be achieved. It is noted that $NO_x$ reduction with the value of $NO_x$ generation being not more than 10 ppm will hereinafter be referred to as super $NO_x$ reduction.

Also, from recent years' regulations of $NO_x$ value, there has been an increasing demand for achieving regulation values not only at some operating points but also over a wider range of operating points, i.e., those throughout a day or a year. The above-mentioned prior art technique was not one that could meet this demand.

Further, the present applicant, through continued studies on the super $NO_x$ reduction technique of steam boilers in response to the society's demand, has reached a practicalization of a super $NO_x$ reduction technique with steam boilers. During the process of studies on this super $NO_x$ reduction technique, the applicant found out that in order to realize a stable super $NO_x$ reduction, controlling the excess air ratio to a constant one is of importance and the greatest factor of variations in excess air ratio is outside-air temperature.

SUMMARY OF THE INVENTION

An object of the present invention is to provide a combustion apparatus for $NO_x$ reduction capable of achieving stable $NO_x$ reduction with simple means.

The present invention having been accomplished to solve the above object, the invention provides a combustion apparatus for $NO_x$ reduction by suppressing temperature of combustion gas derived from a burner, comprising: $NO_x$ reduction means having an excess air ratio versus $NO_x$ characteristic ($NO_x$ emission characteristic) that generated $NO_x$ value decreases with increasing excess air ratio of the burner, and an excess air ratio versus CO characteristic that exhaust CO value increases with increasing excess air ratio; and excess-air-ratio control means for controlling the excess air ratio of the burner to a specified excess air ratio, wherein the excess-air-ratio control means includes outside-air temperature detection means and controls the excess air ratio to the specified excess air ratio based on a detection signal derived from the outside-air temperature detection means.

In one embodiment, there is provided a combustion apparatus for $NO_x$ reduction as described above, wherein the excess-air-ratio control means includes combustion-use-air flow rate adjusting means provided on an air supply passage and serving for feeding combustion-use air to the burner, and the combustion-use-air flow rate adjusting means controls an opening of the combustion-use-air flow rate adjusting means based on a detection signal derived from the outside-air temperature detection means, thereby fulfilling the control to the specified excess air ratio.

In one embodiment, there is provided a combustion apparatus for $NO_x$ reduction as described above, wherein the combustion-use-air flow rate adjusting means includes: a damper; positioning means for determining rotational position of the damper; and fine adjustment means for acting on the positioning means to finely adjust the rotational position of the damper in response to a detected temperature of the outside-air temperature detection means.

In one embodiment, there is provided a combustion apparatus for $NO_x$ reduction as described above, wherein the excess-air-ratio control means controls rotational speed of a blower, which feeds combustion-use air to the burner, based on a detection signal derived from the outside-air temperature detection means, thereby fulfilling the control to the specified excess air ratio.

Further, aspects of the present invention will be described according to the embodiments. Before the description of the embodiments, terms used herein and the drawings are explained. The combustion gas includes burning-reaction ongoing (under-combustion-process) combustion gas, and combustion gas that has completed burning reaction. Then, the burning-reaction ongoing gas refers to combustion gas that is under burning reaction, and the burning-completed gas refers to combustion gas that has completely burning-reacted. The burning-reaction ongoing gas is indeed a concept of substance, but can also be referred to as flame as a concept of state because it generally includes a visible flame so as to be in a flame state. Therefore, herein, the burning-reaction ongoing gas is referred to also as flame or burning flame from time to time. Further, the exhaust gas (flue gas) refers to burning-completed gas that has decreased in temperature under an effect of endothermic action by heat transfer tubes or the like.

Also, the combustion gas temperature, unless otherwise specified, means the temperature of burning-reaction ongoing gas, equivalent to combustion temperature or combustion flame temperature. Further, the suppression of combustion gas temperature refers to suppressing the maximum value of combustion gas (combustion flame) temperature to a low one. In addition, normally, burning reaction is continuing although in a trace amount even in the burning-completed gas, and so the combustion completion does not mean a 100% completion of burning reaction.

Further, the excess air ratio, which is expressed as (actual amount of combustion air)/(theoretical amount of combustion air), corresponds in a specified relationship to exhaust-gas $O_2$(%) (oxygen concentration in exhaust gas), therefore being expressed in exhaust-gas $O_2$(%). Also, the value of $NO_x$ shows a value at 0% $O_2$ in the exhaust gas, dry basis, while the value of CO shows not an equivalent value but a reading value.

Next, as a detailed description of the foregoing characteristics of the present invention, embodiments of the present invention are described. The present invention is applied to thermal equipment (or combustion equipment) such as small-size once-through boilers or other water-tube boilers, water heaters, reheaters of absorption refrigerators or the like. The thermal equipment has a burner and a group of heat absorbers to be heated by combustion gas derived from the burner.

An embodiment of the apparatus according to the present invention is a $NO_x$ reduction combustion apparatus for fulfilling $NO_x$ reduction by controlling temperature of combustion gas derived from a burner, comprising: $NO_x$ reduction means having an excess air ratio versus $NO_x$ characteristic that generated $NO_x$ value decreases with increasing excess air ratio of the burner, and an excess air ratio versus CO characteristic that exhaust CO value increases with increasing excess air ratio; and excess-air-ratio control means for controlling the excess air ratio of the burner to a specified excess air ratio, wherein the excess-air-ratio control means includes outside-air temperature detection means and controls the excess air ratio to the specified excess air ratio based on a detection signal derived from the outside-air temperature detection means.

The specified high excess air ratio is determined in the following manner. Given a $NO_x$ reduction target value of 10 ppm, an excess air ratio corresponding to the target value is determined under the condition of the excess air ratio versus $NO_x$ characteristic of the $NO_x$ reduction means, and then the excess air ratio determined in this way or a value higher than the excess air ratio is taken as a specified high excess air ratio. Finally, the specified high excess air ratio corresponds to the $NO_x$ reduction target value.

The outside-air temperature detection means detects outside-air temperature, i.e., room temperature of a room in which thermal equipment is installed. By this outside-air temperature detection means, combustion-use-air flow rate adjusting means such as a blower or a damper provided on the air inlet passage between the blower and the burner is controlled so that the excess air ratio is controlled to a constant one.

According to the excess air ratio control by this outside-air temperature detection means, since the outside-air temperature that is the greatest factor of variations in excess air ratio of thermal equipment, i.e., variations in generated $NO_x$ value is directly captured and controlled, stable control of $NO_x$ value can be achieved regardless of simple control constitution. Also, the exhaust CO value derived from the $NO_x$ reduction means can also be controlled to a constant one.

Further, the excess-air-ratio control means may also be so designed that the excess air ratio is controlled to a specified one by controlling the opening of a combustion-use-air flow rate adjusting means such as a damper, valve or the like provided in the upstream of the blower, for example, on the air inlet passage of the blower, in another embodiment.

Preferably, the combustion-use-air flow rate adjusting means includes a damper, positioning means for determining rotational position of the damper, and fine adjustment means for acting on the positioning means to finely adjust the rotational position of the damper in response to a detected temperature of the outside-air temperature detection means.

The $NO_x$ reduction means is implemented, preferably, by a $NO_x$ reduction means that makes the generated $NO_x$ value not more than 10 ppm. This $NO_x$ reduction means has an excess air ratio versus $NO_x$ characteristic that the generated $NO_x$ value decreases with increasing excess air ratio of the burner, where the generated $NO_x$ value decreases to not more than 10 ppm at not less than a specified excess air ratio, as well as an excess air ratio versus CO characteristic that the exhaust CO value increases with increasing excess air ratio. This excess air ratio versus CO characteristic has a characteristic that if the excess air ratio is set to such a value that the generated $NO_x$ value falls under 10 ppm, then the exhaust CO value abruptly increases.

A preferable mode of the $NO_x$ reduction means is that combustion gas temperature is suppressed by a combination of: a combustion-gas-temperature suppression means for doing the suppression by burning a fully-premixing type gas burner at a high excess air ratio (hereinafter, referred to as "first suppression means"); a combustion-gas-temperature suppression means for doing the suppression by heat absorbers (hereinafter, referred to as "second suppression means"); a combustion-gas-temperature suppression means for doing the suppression by recirculating burning-completed gas to a burning reaction zone (hereinafter, referred to as "third suppression means"); and a combustion-gas-temperature suppression means for doing the suppression by addition of water or addition of steam (hereinafter, referred to as "water/steam addition") to the burning reaction zone (hereinafter, referred to as "fourth suppression means"). The burning reaction zone refers to a zone where burning-reaction ongoing gas is present.

The first suppression means is based on the following principle. That is, when the burner is burned at a high excess air ratio, the combustion gas temperature is suppressed so that the $NO_x$ value decreases. The high excess air ratio in this case is 5% $O_2$ or more contained in exhaust gas, preferably, not less than 5.5% $O_2$. This suppression effect acts generally uniformly on the entire burning reaction zone formed by the burner.

The second suppression means is based on the following principle. That is, the $NO_x$ value is reduced by suppressing the combustion gas temperature by a cooling effect of heat absorbers implemented by arranging a multiplicity of heat absorbers in the burning-reaction ongoing gas derived from the burner, i.e., in the burning reaction zone. This second suppression means is implemented by arranging the heat absorbers to cool the burning-reaction ongoing gas, hence a nonuniform cooling. There are also sites where the burning is ongoing actively in the gaps between the heat absorbers of the burning reaction zone. Particularly in the downstream of the heat absorbers, eddy currents are formed so that the combustion flame is stabilized by the heat absorbers. The heat absorbers are implemented by heat transfer tubes such as water tubes, but this is not limitative.

The arrangement configuration as to how the heat absorbers are arranged with respect to the flow of the burning-reaction ongoing gas, includes the following two modes. One of those arrangement configurations is that a combustion gas passage is formed so as to allow combustion gas to flow generally linearly therethrough from the burner to the exhaust gas outlet, and moreover the heat absorbers are arranged so as to cross the burning-reaction ongoing gas derived from the burner with gaps present among the heat absorbers to allow the combustion gas to flow therethrough. The other arrangement configuration is that heat absorbers are arrayed in an annular state with gaps present thereamong to allow the combustion gas to flow therethrough, so that the combustion gas derived from the burner flows radially from the inside of the annular heat absorbers toward the heat absorbers, where the heat absorbers are arranged in the burning-reaction ongoing gas derived from the burner. The latter configuration is described in detail in U.S. Pat. No. 6,029,614, the disclosure of which is hereby incorporated by reference.

The third suppression means is what is called exhaust-gas recirculation combustion method. Exhaust gas which has decreased in temperature through endothermic action by the heat absorbers and is then to be emitted to the atmosphere is partly mixed with combustion-use air via an exhaust-gas recirculation passage. The combustion gas temperature is suppressed by a cooling effect of the mixed exhaust gas, by which $NO_x$ value is reduced. This third suppression means also exerts uniform cooling of combustion gas.

The fourth suppression means is water/steam addition to the burning reaction zone. By this water/steam addition, the burning-reaction ongoing gas is cooled, so that the combustion gas temperature is suppressed and the $NO_x$ value is reduced. This fourth suppression means also exerts uniform cooling of the combustion gas. The water/steam addition may be carried out in the exhaust-gas recirculation passage in another embodiment. Besides, in an embodiment in which the burner is provided as a fully-premixing type gas burner and mixed gas of combustion-use air and fuel gas is fed to the burner by a blower, it is possible to perform the steam addition between the burner and the blower. For the water addition, water is added in the form of mist.

Working effects by the combination of the first to fourth suppression means are as follows. Enhancing the functions of the individual suppression means singly would cause drawbacks of the respective suppression means to matter. However, combining the four suppression means makes it possible to achieve super $NO_x$ reduction relatively easily without causing the emergence of those drawbacks. In particular, later-described unstable characteristics of the fourth suppression means are alleviated, so that stable $NO_x$ reduction can be achieved.

It is noted that the functional enhancement of the first suppression means (premixing high excess-air-ratio combustion) is to increase the excess air ratio. Due to this functional enhancement, there would occur a halt of burning reaction and an unstable combustion of the combustion burner. Also, the functional enhancement of the second suppression means (heat-absorber cooling) is the provision of the heat transfer tubes in contact with the burner or the increasing of the heat-transfer-surface density of the heat absorbers. Due to this functional enhancement, there would occur an increase in pressure loss or an unstable combustion such as oscillating combustion.

Also, the functional enhancement of the third suppression means (exhaust gas recirculation) is to increase the exhaust-gas recirculation quantity. Due to this functional enhancement, there would occur an amplification of the unstable characteristics of the third suppression means. That is, the exhaust gas recirculation has a characteristic that the exhaust-gas flow rate or temperature changes with changes in combustion quantity or changes in load. An increase in the exhaust-gas recirculation quantity would cause these unstable characteristics to be amplified, making it impossible to achieve a stable super $NO_x$ reduction. Also, due to the functional enhancement of the third suppression means, burning reaction would be suppressed, causing an emission increase of CO and unburned components as well as an increase in thermal loss. Further, increasing the exhaust-gas recirculation quantity would cause the blower load to increase.

Also, the functional enhancement of the fourth suppression means (water addition/steam addition) is to increase the quantity of water to be added. Due to this functional enhancement, the quantity of condensations would increase with increasing thermal loss, where, particularly in boilers having a feed water preheater for preheating the water fed to the heat absorbers by exhaust gas, there would matter corrosion of the feed water preheater due to the condensations.

According to the preferable embodiments of the $NO_x$ reduction means as described above, since the first to fourth suppression means are combined together, the problems that would otherwise emerge upon enhancing the functions of the individual suppression means each singly can be prevented from becoming issues.

Further, the $NO_x$ reduction means includes the following five modifications: (1) a mode in which three suppression means of the second suppression means (heat-absorber cooling), the third suppression means (exhaust gas recirculation) and the fourth suppression means (water/steam addition) are combined together excluding the first suppression means (premixing high excess-air-ratio combustion); (2) a mode in which three suppression means of the first suppression means (premixing high excess-air-ratio combustion), the second suppression means (water-tube cooling) and the third suppression means (exhaust gas recirculation) are combined together; (3) a mode in which three suppression means of the first suppression means (premixing high excess-air-ratio combustion), the second suppression means (heat-absorber cooling) and the fourth suppression means (water/steam addition) are combined together; (4) a mode in which two suppression means of the second suppression means (water-tube cooling) and the third suppression means (exhaust gas recirculation) are combined together; and (5) a mode in which two suppression means of the second suppression means (heat-absorber cooling) and the fourth suppression means (water/steam addition) are combined together.

DETAILED DESCRIPTION OF THE PREFERRED EMBODIMENTS

Figure 1:
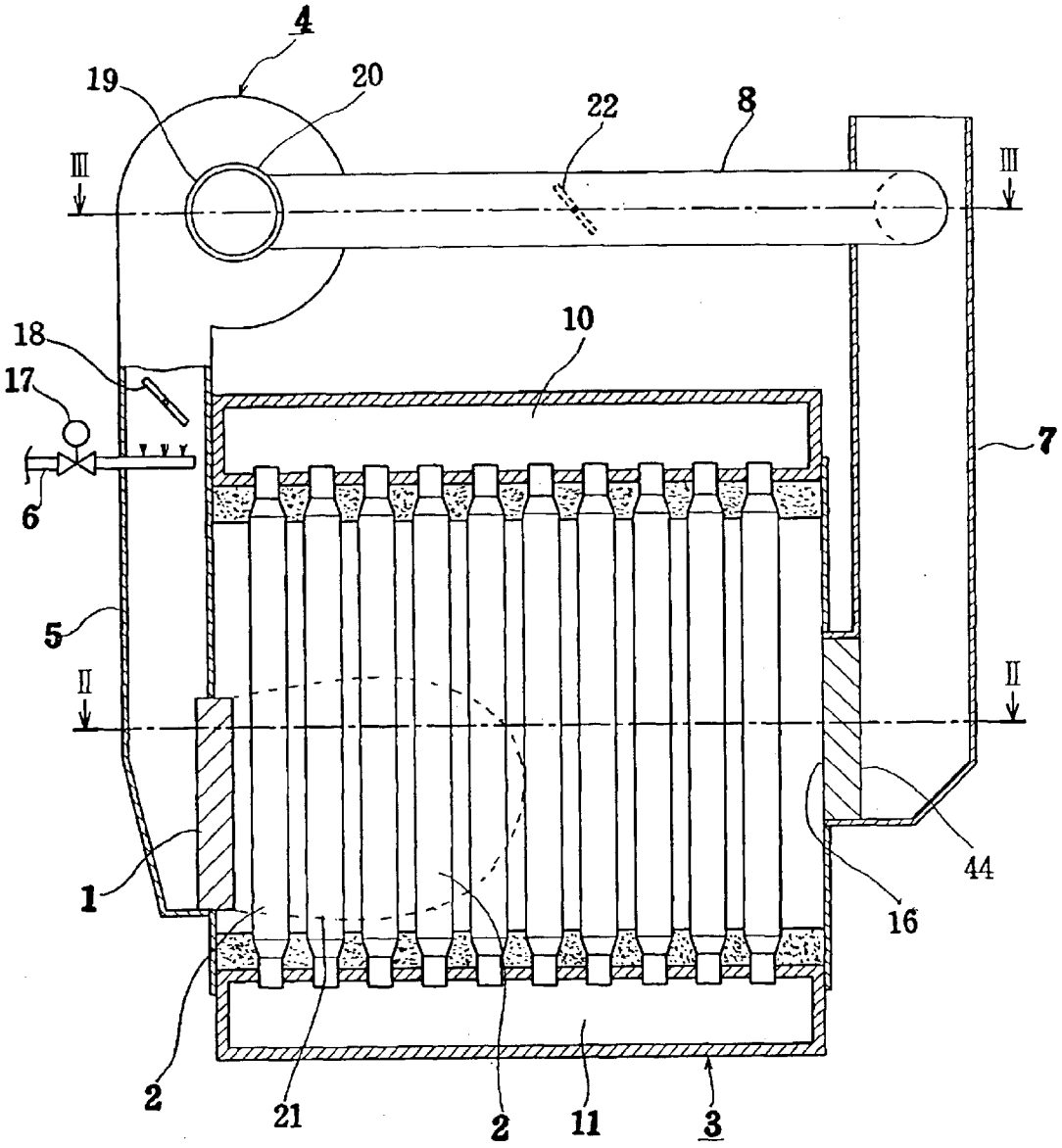
FIG. 1 is an explanatory view of a longitudinal section of a steam boiler to which an embodiment of the present invention is applied.
Figure 2:
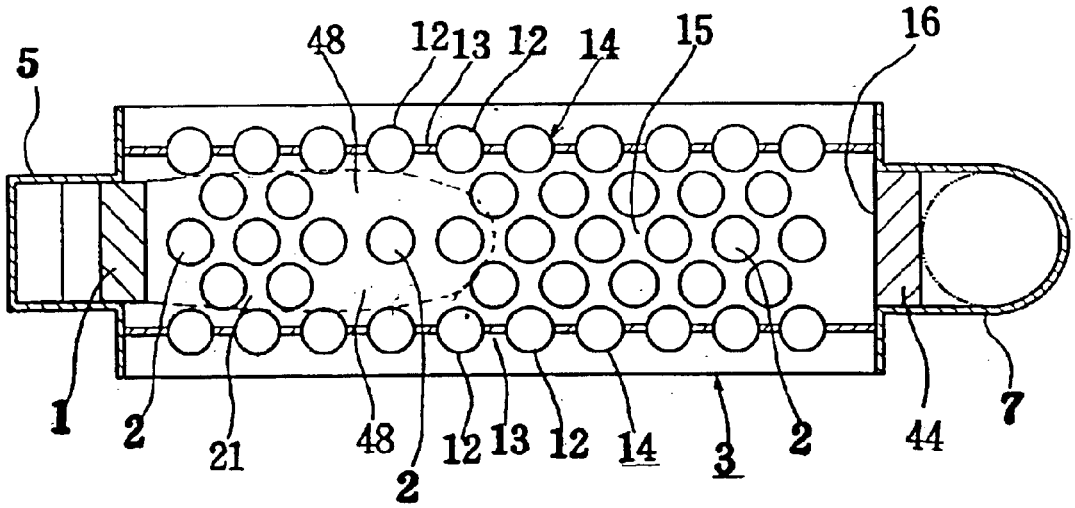
FIG. 2 is a sectional explanatory view taken along the line II—II of FIG. 1.
Figure 3:
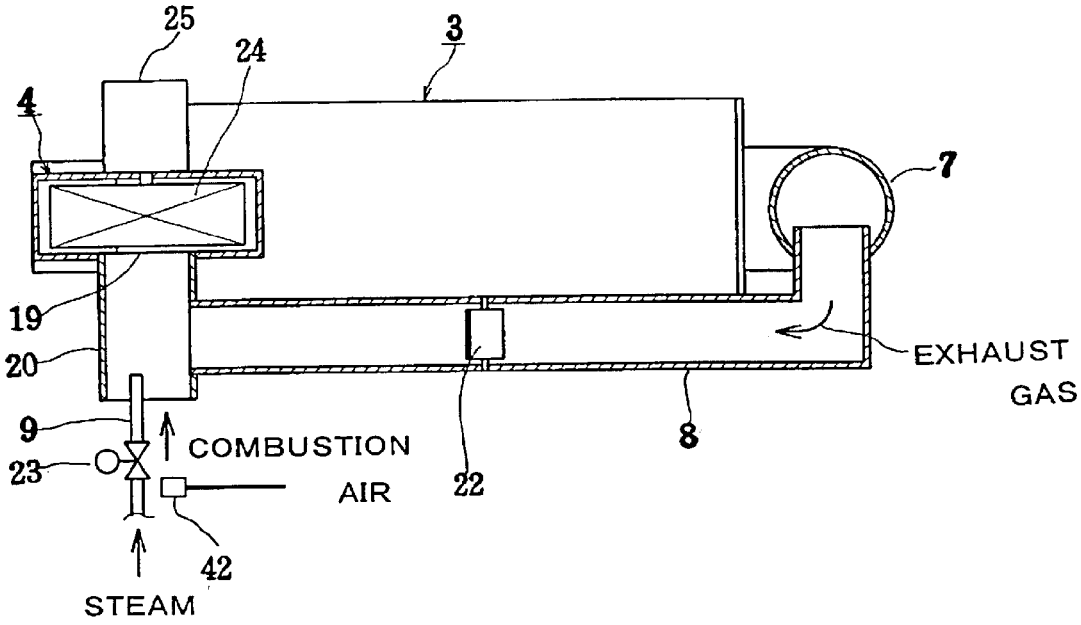
FIG. 3 is a cross-sectional explanatory view taken along the line III—III of FIG. 2.
Figure 4:
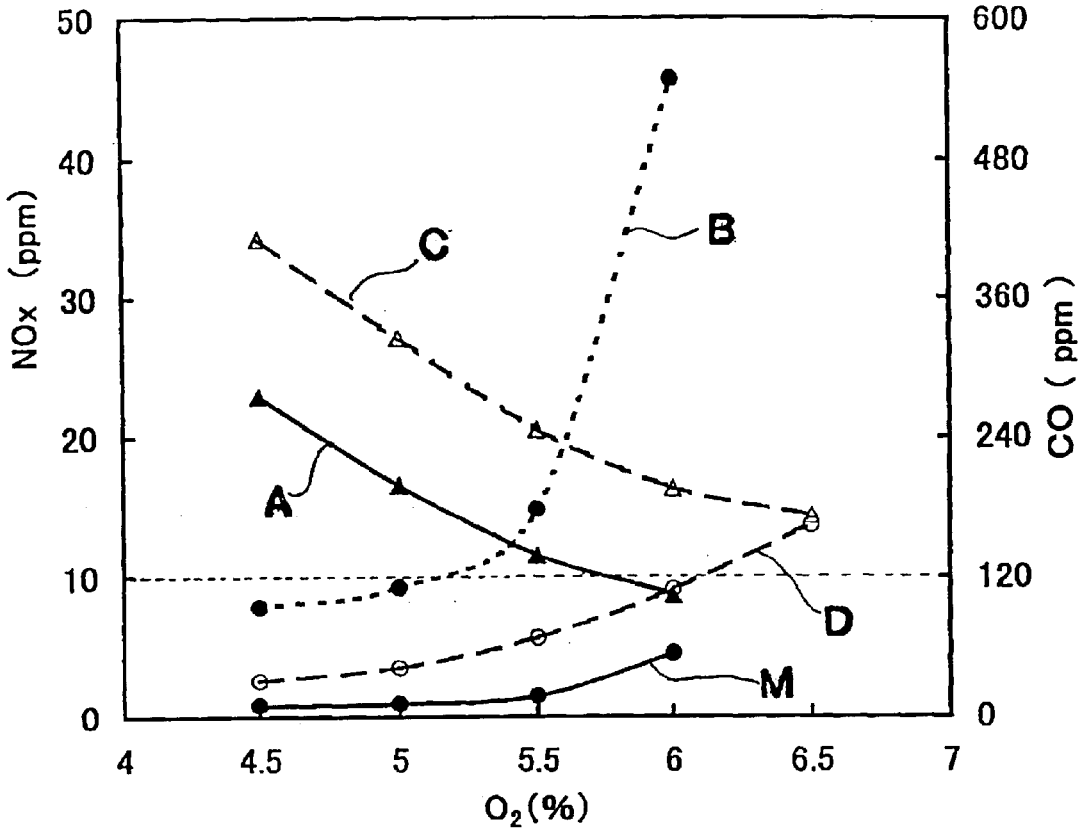
FIG. 4 is a chart showing excess air ratio versus $NO_x$ characteristic ($NO_x$ emission characteristic) curves, and excess air ratio versus CO characteristic (CO emission characteristic) curves in high combustion state of the same steam boiler.
Figure 5:
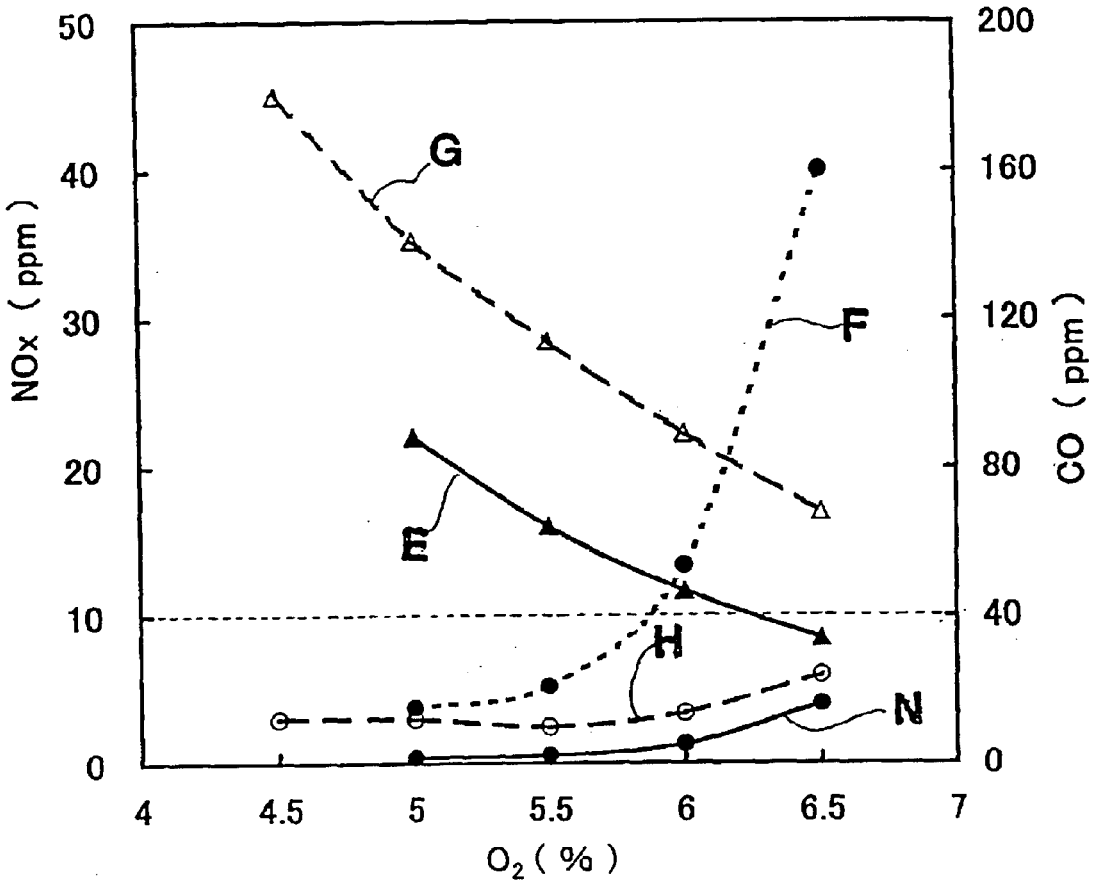
FIG. 5 is a chart showing excess air ratio versus $NO_x$ characteristic curves, and excess air ratio versus CO characteristic curves in low combustion state of the same steam boiler.
Figure 6:
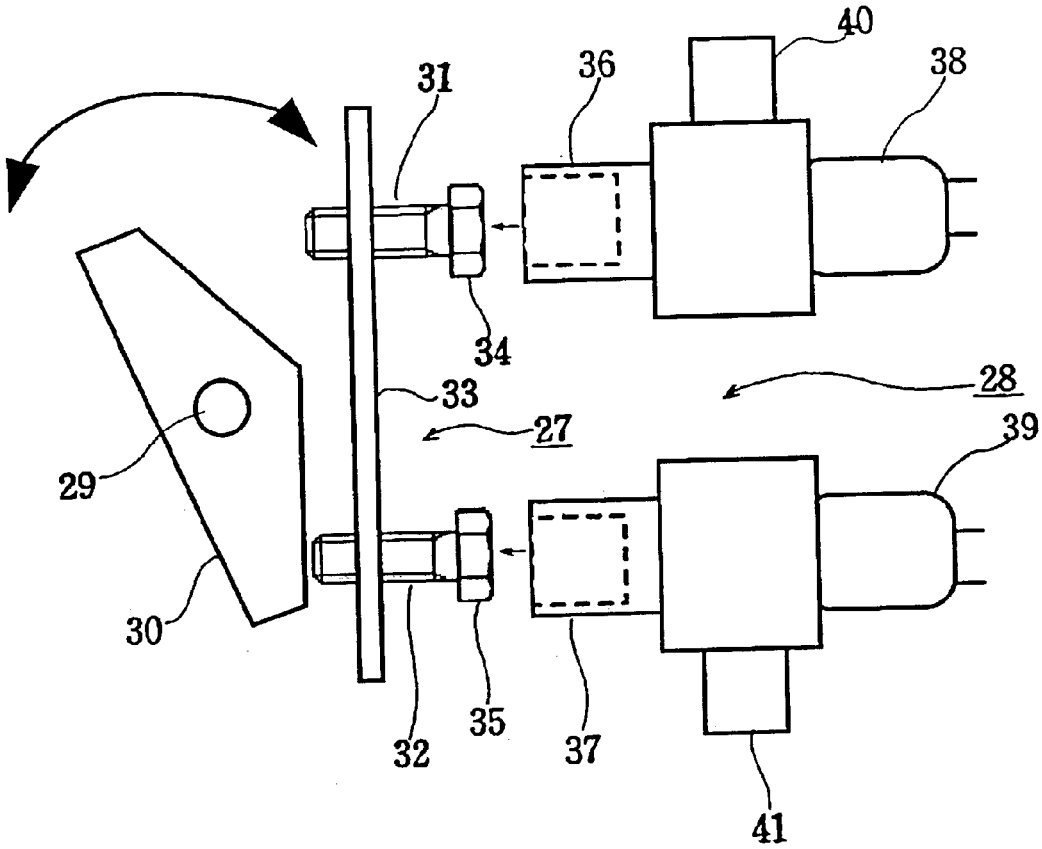
FIG. 6 is a main-part exploded explanatory view of the same steam boiler.
Figure 7:
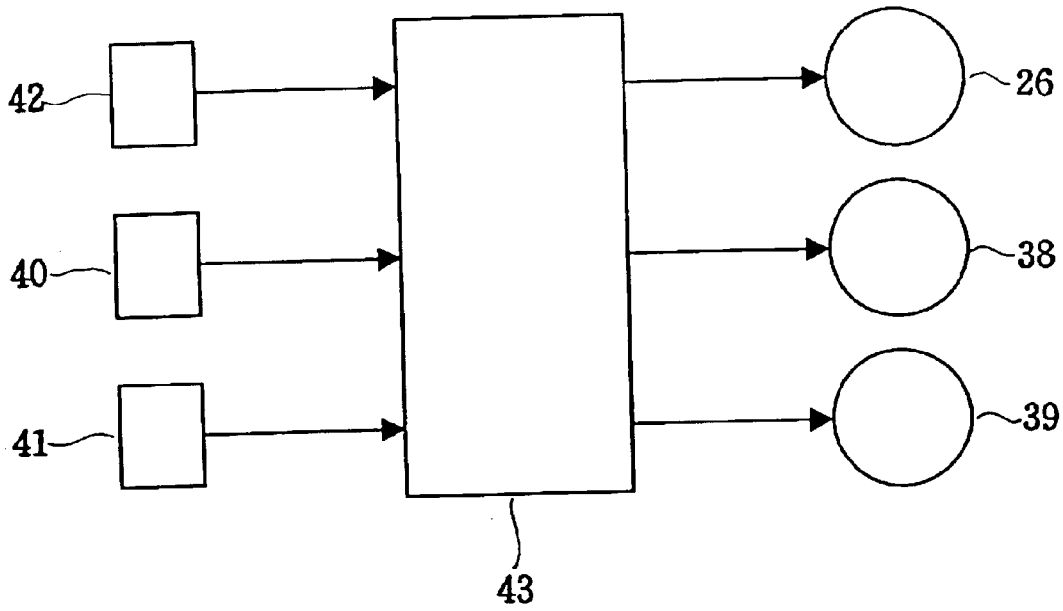
FIG. 7 is a main-part control circuit diagram of the same steam boiler.
Figure 8:
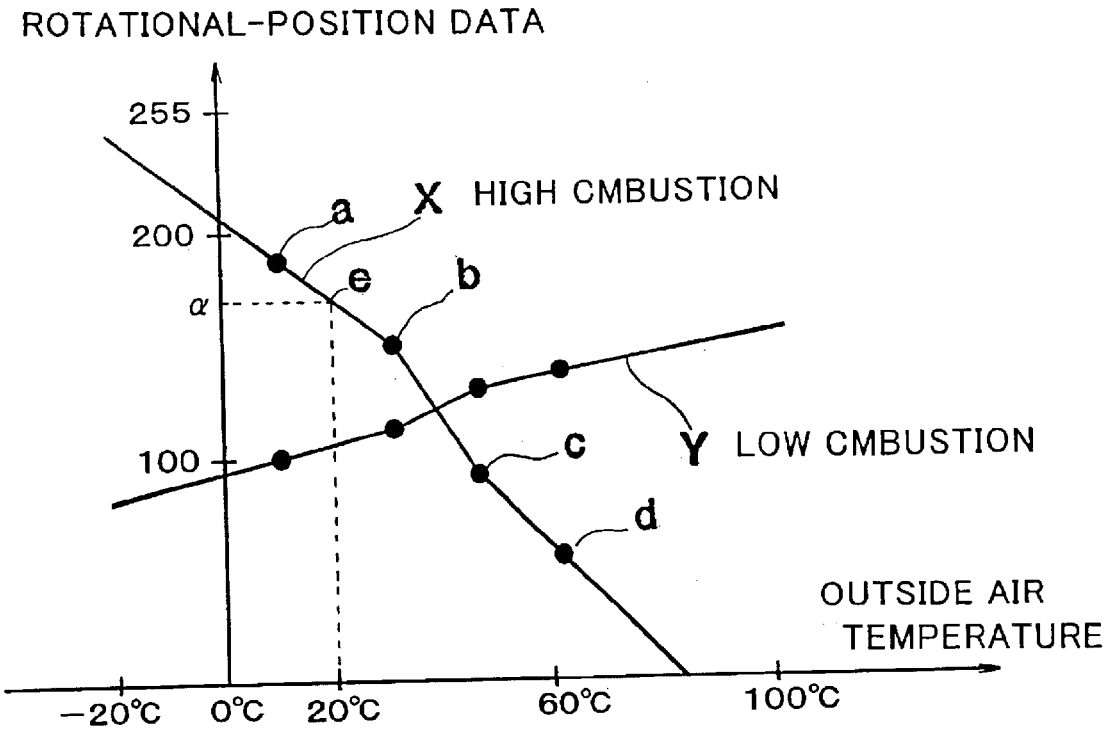
FIG. 8 is a chart showing outside-air temperature versus excess air ratio correction data of the same steam boiler.
Figure 9:
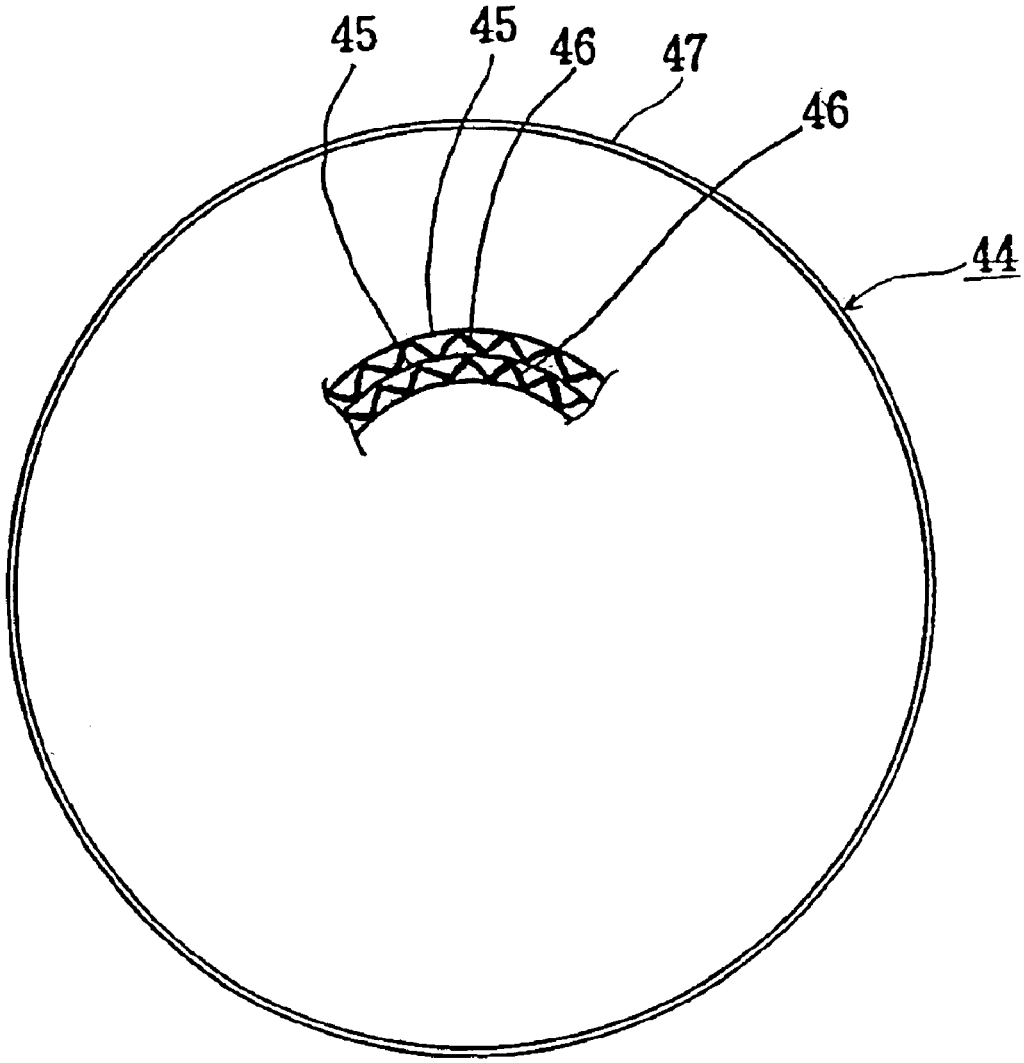
FIG. 9 is a front view showing a main-part constitution of a CO oxidation catalyst member in the same steam boiler.

Hereinbelow, working examples in which the $NO_x$ reduction and CO reduction combustion method and apparatus of the present invention are applied to a once-through steam boiler, which is one type of water-tube boilers, are described in accordance with the accompanying drawings. FIG. 1 is an explanatory view of a longitudinal section of a steam boiler to which an embodiment of the present invention is applied, FIG. 2 is a sectional view taken along the line II—II of FIG. 1, FIG. 3 is a cross-sectional view taken along the line III—III of FIG. 1, FIGS. 4 and 5 are charts showing excess air ratio versus $NO_x$ characteristic curves as well as excess air ratio versus CO characteristic curves in high combustion state and low combustion state, respectively, of the embodiment, FIG. 6 a main-part exploded explanatory view of the excess-air-ratio control means of the embodiment, FIG. 7 is a main-part control circuit diagram of the embodiment, FIG. 8 is a chart showing outside-air temperature versus excess air ratio correction data of the embodiment, and FIG. 9 is a main-part constitution of a CO oxidation catalyst member in the embodiment, as viewed along the direction of the exhaust gas flow.

Now the overall construction of the boiler according to this embodiment is explained below, and then the construction of its characteristic parts is explained. The characteristic parts include: $NO_x$ reduction means for performing $NO_x$ reduction in combination of a combustion-gas-temperature suppression means for doing the suppression by burning a fully-premixing type gas burner at a high excess air ratio (first suppression means), a combustion-gas-temperature suppression means for doing the suppression by a multiplicity of heat transfer tubes (second suppression means), a combustion-gas-temperature suppression means for doing the suppression by recirculating burning-completed gas to a burning reaction zone (third suppression means), and a combustion-gas-temperature suppression means for doing the suppression by addition of water or steam to the burning reaction zone (fourth suppression means); an excess-air-ratio control means for controlling the excess air ratio of the burner to maintain it at a specified high excess air ratio; and a CO reduction means for reducing the exhaust CO value to a specified value or lower by oxidizing CO emitted from the $NO_x$ reduction means.

First, the overall construction of the steam boiler is explained. This steam boiler is switchable between operations at high combustion and low combustion. Then, the steam boiler comprises: a boiler body 3 having a fully-premixing type burner 1 having a planar. i.e. flat-shaped burning surface (jet-out surface for premixed gas) and a multiplicity of endothermic-use heat transfer tubes 2, 2, . . . ; a blower 4 and an air supply passage 5 for feeding combustion-use air to the burner 1; a gas fuel supply tube 6; an exhaust gas passage (normally referred to as flue) 7 for discharging exhaust gas exhausted from the boiler body 3; an exhaust-gas recirculation passage 8 for mixing, into the combustion-use air, part of the exhaust gas that is circulating along the exhaust gas passage 7 to feed it to the burner 1; and a steam addition tube 9 (see FIG. 3) for adding steam to the combustion-use air. It is noted that the outer diameter of each of the heat transfer tubes 2 is 60.5 mm.

The boiler body 3 is provided with an upper header 10 and a lower header 11, and has a plurality of the heat transfer tubes 2 arranged between the two headers 10. 11. Referring to FIG. 2, a pair of water walls 14, 14 formed by coupling outer heat transfer tubes 12, 12, . . . to one another with coupling members 13, 13, . . . are provided on lengthwise both sides of the boiler body 3, so that a combustion gas passage 15 that allows burning-reaction ongoing gas and burning-completed gas derived from the burner 1 to pass generally linearly therethrough is formed between the two water walls 14, 14 and the upper header 10 and the lower header 11.

Next, conjunction relationships among the foregoing individual elements are explained. As shown in FIG. 1, the burner 1 is provided at one end of the combustion gas passage 15, and the exhaust gas passage 7 is connected to an exhaust gas outlet 16 located at the other end. The air supply passage 5 is connected to the burner 1, and the gas fuel supply tube 6 is connected to the air supply passage 5 so that fuel gas is jetted out into the air supply passage 5. The gas fuel supply tube 6 is provided with a first valve 17 as a fuel flow adjusting means for adjusting the fuel flow between high combustion and low combustion. On the air supply passage 5, a first damper 18 as the combustion-use-air flow rate adjusting means for adjusting the combustion-use air quantity between high combustion and low combustion is provided on the downstream side of the blower 4. Further, on the air supply passage 5 is provided a throttle portion (not shown), which is so called venturi, for enhancing the mixability of the fuel gas and the combustion-use air, but the throttle portion may be omitted for reduction of pressure loss according to the embodiment.

Further, as shown in FIG. 3, an air inlet passage 20 is connected to an inlet port 19 of the blower 4, and the exhaust-gas recirculation passage 8 is connected between the air inlet passage 20 and the exhaust gas passage 7. The steam addition tube 9 is inserted in the air inlet passage 20.

Operation of this steam boiler based on the above-described constitution is outlined below. In the air supply passage 5, combustion-use air (outside air) fed through the air inlet passage 20 is premixed with fuel gas fed through the gas fuel supply tube 6, and the resulting premixed gas is jetted out from the burner 1 into the boiler body 3. The premixed gas is ignited by an ignition means (not shown), thus burning. Burning-reaction ongoing gas generated along with this burning crosses with upstream-side heat transfer tubes 2 so as to be cooled, resulting in burning-completed gas, which exchanges heat with downstream-side heat transfer tubes 2 so that its heat is absorbed, thus resulting in exhaust gas. The resultant exhaust gas is discharged into the atmosphere through the exhaust gas passage 7. Then, part of the exhaust gas is fed to the burner 1 through the exhaust-gas recirculation passage 8, and used for suppression of combustion gas temperature.

Water in the individual heat transfer tubes 2 is heated by the heat exchange with the combustion gas, thereby changed into steam. This steam is fed from a steam extraction means (not shown), which is connected to the upper header 10, to steam-utilizing equipment (not shown), while part of the steam is fed to the steam addition tube 9 so as to be used for suppression of combustion gas temperature.

Next, the above-noted characteristic parts of this embodiment are explained. The $NO_x$ reduction means reduces the generated $NO_x$ value to 10 ppm or less at not more than a specified excess air ratio. First, the first suppression means forming part of the $NO_x$ reduction means is explained. This first suppression means is so structured that the fully-premixing type burner 1 burns at a high excess air ratio. When the burner 1 is put into burning at a high excess air ratio, the combustion gas temperature lowers, so that the value of $NO_x$ lowers. The burner 1 is a longitudinally 60 cm, laterally 18 cm sized rectangular-shaped burner, having a multiplicity of premixed-gas nozzles (not shown) formed generally evenly therein.

The second suppression means is so constructed that a multiplicity of the heat transfer tubes 2 are arranged generally all over the burning reaction zone (a zone where the combustion gas temperature is not less than about 900° C.) 21 formed by the burner 1, with gaps present thereamong to allow the combustion gas to flow therethrough. The burning-reaction ongoing gas derived from the burner 1 is cooled by these heat transfer tubes 2. As a result of this cooling, the combustion gas temperature is suppressed, so that the value of $NO_x$ is lowered. The arrangement pitch of the heat transfer tubes 2, which affects the degree of cooling of the combustion gas, is determined in consideration of the amount of combustion per time, pressure loss and the like.

The third suppression means is an exhaust-gas recirculating means composed of the exhaust gas passage 7, the exhaust-gas recirculation passage 8, the air supply passage 5 and the burner 1. At a proper place within the exhaust-gas recirculation passage 8 is provided a second damper 22 as an exhaust-gas flow rate adjusting means for adjusting the exhaust-gas recirculation quantity to a specified quantity between high combustion state and low combustion state. Mixing exhaust gas with the premixed gas fed to the burner 1 causes the combustion gas temperature to be suppressed, so that the value of $NO_x$ lowers. The ratio (exhaust-gas recirculation rate) of the quantity of exhaust gas to be recirculated (exhaust-gas recirculation quantity) to the combustion-use air quantity (actual combustion air quantity) is adjusted by the second damper 22 so as to be kept unchanged between high combustion state and low combustion state.

The fourth suppression means, as shown in FIG. 3, is composed of the steam addition tube 9, the air inlet passage 20, the blower 4, the air supply passage 5 and the burner 1. A counter-addition-side end of the steam addition tube 9 Is connected to the upper header 10 via a second valve 23 serving as a steam flow rate adjusting means for adjusting the quantity of steam addition, so that steam generated by the steam boiler is utilized as it is. Between the second valve 23 and the upper header 10 is provided an orifice or other pressure reducing mechanism (not shown). The steam is mixed uniformly into the combustion-use air fed to the burner 1, and jetted out into the boiler body 3 generally uniformly from a multiplicity of premixed-gas nozzles (not shown) of the burner 1. As a result, an effective cooling of the formed premixed combustion flame is achieved.

The steam boiler of this working example, as stated before, is switchable between operations at high combustion and low combustion. Then, the $NO_x$ reduction means of the steam boiler has the excess air ratio versus $NO_x$ characteristics and the excess air ratio versus CO characteristics in high combustion state and low combustion state shown in FIGS. 4 and 5. These excess air ratio versus $NO_x$ characteristics and excess air ratio versus CO characteristics are obtained by the combination of the first suppression means to the fourth suppression means. The excess air ratio versus $NO_x$ characteristics and excess air ratio versus CO characteristics of this $NO_x$ reduction means are now explained.

First, the excess air ratio versus $NO_x$ characteristic and the excess air ratio versus CO characteristic in the high combustion state are determined as shown by a curve A and a curve B, respectively, of FIG. 4 with the excess air ratio varied under certain operating conditions. These operating conditions are a fuel of LPG, a combustion rate of the burner 1 of 50 $Nm^3/h$ (combustion rate of the steam boiler at high combustion), an exhaust-gas recirculation rate of 4% (exhaust-gas recirculation quantity/actual combustion air quantity), and a steam addition amount of 17 kg/h. Then, the actual combustion air quantity and the exhaust-gas recirculation quantity at the exhaust-gas recirculation rate of 4% are 1669 $Nm^3/h$ and 67 $Nm^3/h$, respectively, at 6% $O_2$, for instance. Varying the excess air ratio is implemented by varying the actual combustion air quantity.

Varying the actual combustion air quantity is implemented by controlling the rotational speed of an a.c.-driven first electric motor 25 (see FIG. 3) that drives a fan 24 of the blower 4 or by varying the opening (rotational position) of the first damper 18. It is noted that the curve C and the curve D in FIG. 4 represent an excess air ratio versus $NO_x$ characteristic and an excess air ratio versus CO characteristic of comparative examples in which the suppressions of combustion gas temperature by the third suppression means and the fourth suppression means are not performed, given for contrast to the curve A and the curve B of the working example.

The excess air ratio versus $NO_x$ characteristic in the high combustion state of the $NO_x$ reduction means is, as shown by the curve A, one that the $NO_x$ value decreases with increasing excess air ratio. Also, the excess air ratio versus CO characteristic is, as shown by the curve B, one that the exhaust CO value increases with increasing excess air ratio, in particular, the exhaust CO value abruptly increases at 5% $O_2$ or more.

Next, the excess air ratio versus $NO_x$ characteristics and the excess air ratio versus CO characteristic in the low combustion state of the $NO_x$ reduction means are explained below. These characteristics are determined as shown by a curve E and a curve F, respectively, of FIG. 5 as in the case of the high combustion state. The operating conditions in the low combustion state are a fuel of LPG, a combustion rate of the burner of 25 $Nm^3/h$ (combustion rate of the steam boiler at low combustion), an exhaust-gas recirculation rate of 4% (exhaust-gas recirculation quantity/actual combustion air quantity), and a steam addition amount of 8.5 kg/h. Then, the actual combustion air quantity and the exhaust-gas recirculation quantity at the exhaust-gas recirculation rate of 4% are 834 $Nm^3/h$ and 33 $Nm^3/h$, respectively, at 6% $O_2$, for instance. It is noted that a curve G and a curve H in FIG. 5 represent an excess air ratio versus $NO_x$ characteristic and an excess air ratio versus CO characteristic of comparative examples in which the suppressions of combustion gas temperature by the third suppression means and the fourth suppression means are not performed.

The excess air ratio versus $NO_x$ characteristic in the low combustion state of the $NO_x$ reduction means is, as shown by the curve E, also one that the $NO_x$ value decreases with increasing excess air ratio. Further, the excess air ratio versus CO characteristic is, as shown by the curve F, one that the exhaust CO value increases with increasing excess air ratio, in particular, the exhaust CO value abruptly increases at 5.5% $O_2$ or more.

The excess-air-ratio control means controls the excess air ratio of the burner 1 to a specified high excess air ratio (specified value). In this working example, given a $NO_x$ reduction target value of 10 ppm, the specified value can be determined as 5.8% $O_2$ in the high combustion state from the curve A of FIG. 4 and the value of 10 ppm. Of course, an excess air ratio of higher than 5.8% satisfies the reduction target value, and so the specified value may be set to, for example, 6%. For the low combustion state, the specified value can be determined as 6.25% $O_2$ from the curve E of FIG. 5 and the value of 10 ppm.

Concrete constitution of the excess-air-ratio control means is explained with reference to FIGS. 6 to 8. The excess-air-ratio control means which is coupled to a rotating shaft 29 of the first damper 18 (see FIG. 1) as shown in FIG. 6, includes an a.c.-driven second electric motor 26 (see FIG. 7) for rotating the first damper 18, the first damper 18 for adjusting combustion-use air quantity, a positioning means 27 for determining the rotational position of the first damper 18, and a fine adjustment means 28 for finely adjusting the rotational position of the first damper 18. The positioning means 27 and the fine adjustment means 28 are provided outside the air supply passage 5.

The positioning means 27 is made up of a high-combustion-use first adjustment screw 31 and a low-combustion-use second adjustment screw 32 which are in contact with a rotational-position restricting plate 30 fixed to one end of the rotating shaft 29 outside the air supply passage 5, and a base plate 33 to which these screws 31, 32 are attached so as to be longitudinally movable by being rotated.

The fine adjustment means 28 is composed of a first coupling member 36 and a second coupling member 37 to be removably coupled to a first drive portion 34 and a second drive portion 35, respectively, provided at tip end portions of the first adjustment screw 31 and the second adjustment screw 32, respectively, d.c.-driven third electric motor 38 and fourth electric motor 39 for rotationally driving the first coupling member 36 and the second coupling member 37 by their rotating shafts (not shown), and a first rotational-position detection means 40 and a second rotational-position detection means 41 for obtaining rotational-position information on the first coupling member 36 and the second coupling member 37.

The first adjustment screw 31 and the second adjustment screw 32 may be provided with connection-use coil springs (not shown) interposed on their ways, in another embodiment. In this constitution with the connection-use coil springs interposed, the first adjustment screw 31 and the second adjustment screw 32 become bendable and therefore become more easily connectable with the first coupling member 36 and the second coupling member 37, respectively.

The coupling state between the positioning means 27 and the fine adjustment means 28 is described in detail. The first drive portion 34 and the second drive portion 35 are fitted to the first coupling member 36 and the second coupling member 37, respectively, in such a way that the coupled members will rotate integrally without sliding against each other. Whereas this form of fitting is given by a regular hexagonal fitting in the working example, it is also possible that the first drive portion 34 and the second drive portion 35 are each formed into a gear shape (not shown) having a multiplicity of gear grooves so as to provide a gear-groove fitting.

As shown in FIG. 7, the third to fourth electric motors 38, 39 are controlled by an outside-air temperature sensor 42, which serves as the outside-air temperature detection means for detecting the outside-air temperature (intake air temperature) near the entrance of the air inlet passage 20, and a first control circuit 43, to which signals from the first rotational-position detection means 40 and the second rotational-position detection means 41 are inputted, so that the excess air ratio becomes a specified value.

That is, the first control circuit 43 has stored a program for controlling the rotations of the third electric motor 38 and the fourth electric motor 39 so that the excess air ratio of the burner 1 becomes a generally constant value even with the outside-air temperature varied. More specifically, the first control circuit 43 has stored rotational-position data characteristics (excess-air-ratio correction data) of the first coupling member 36 and the second coupling member 37 against the outside-air temperature as shown in FIG. 8. This rotational-position data represent rotational-position data on the first coupling member 36 and the second coupling member 37 obtained from the first rotational-position detection means 40 and the second rotational-position detection means 41, and therefore represent the rotational-position data on the first adjustment screw 31 and the second adjustment screw 32, and further represent the rotational-position data on the first damper 18.

The excess-air-ratio correction data is stored in the first control circuit 43 in the following way. First, assuming that the $NO_x$ reduction target value is 10 ppm, a case of high combustion state is explained. With the steam boiler set in high combustion, a current outside-air temperature is measured by the outside-air temperature sensor 42. Then, by a $NO_x$ value measuring sensor (not shown) provided for measurement on the exhaust gas passage 7, the third electric motor 38 is rotated so that the $NO_x$ value becomes 10 ppm. Rotational-position upon the arrival at 10 ppm obtained from the first rotational-position detection means 40 is measured. Then, data at a measuring point "a" in FIG. 8, in combination of outside-air temperature data and rotational-position data, is obtained and inputted to the control circuit 43.

Next, this measurement is performed similarly at different outside-air temperatures, by which data on the three points of "b," "c," and "d" in FIG. 8 are acquired, and inputted to the first control circuit 43. Upon input of the four-point data, those point-to-point data are automatically interpolated by the first control circuit 43 to prepare a curve X. Whereas data on four points are inputted in FIG. 8, it is designed that inputting data on at least two points allows the curve (straight line in this case) X to be prepared automatically.

Excess-air-ratio correction data of a curve Y in low combustion state on the condition that the $NO_x$ reduction target value is 10 ppm is prepared in the same manner as the curve X, and inputted to the first control circuit 43.

Other than measuring data and inputting measured values as described above, the input of measured data can also be implemented by pressing a setting means (not shown) in the measurement process so that the data is automatically inputted and stored.

Next, the CO reduction means is explained. This CO reduction means oxidizes CO emitted from the $NO_x$ reduction means to achieve CO reduction below a CO reduction target value. The CO reduction means in this working example is implemented by a CO oxidation catalyst member 44 that reduces the CO value to about 1/10. CO reduction characteristic by this CO oxidation catalyst member 44 is shown by a curve M of FIG. 4 and a curve N of FIG. 5. CO quantities in the exhaust gas shown by the curve D and the curve E are finally reduced as shown by the curve M and the curve N, respectively.

This CO oxidation catalyst member 44, having such a structure shown in FIG. 7, is formed in the following manner, for example. With a flat plate 45 and a wave plate 46 as base materials, both of which are made of stainless, a multiplicity of minute pits and bumps are formed on their surfaces, and oxidation catalyst is applied on top of the surfaces. Then, the flat plate 45 and the wave plate 46 are cut into a specified elongate shape and laid on each other and spirally rolled into a roll state. This roll is surrounded and fixed by a side plate 47. In this way, the CO oxidation catalyst member 27 as shown in FIG. 7 is formed. Platinum is used as the oxidation catalyst. It is noted that FIG. 7 shows only part of the flat plate 45 and the wave plate 46.

The CO oxidation catalyst member 44, as shown in FIG. 1, is removably fitted to the exhaust gas outlet 16 portion. Size and processing capacity of the CO oxidation catalyst member 44 are designed in consideration of the performance of the oxidation catalyst, the quantity of CO to be oxidized, and the pressure loss occurring when the exhaust gas flows through the CO oxidation catalyst member 44. Further, the $NO_x$ reduction means, as shown in FIG. 2, includes another CO reduction means. This CO reduction means is a heat-transfer-tube removal space 48 called heat insulating space formed by eliminating some of the heat transfer tubes 2. Then, as shown in FIG. 2, part of the heat transfer tubes 2, i.e., four heat transfer tubes 2 in this working example are removed so that the heat-transfer-tube removal space 48 where the combustion gas temperature falls within a range not more than 1400° C. and not less than 900° C. is formed.

The heat-transfer-tube removal space 48 falls generally within the aforementioned temperature range in the high combustion state, while it involves a shorter combustion flame, i.e., a narrower burning reaction zone in the low combustion state so as to no longer fall within the temperature range. Accordingly, the CO oxidation catalyst member 44 and the heat-transfer-tube removal space 48 serve as CO reduction means in the high combustion state, while the heat-transfer-tube removal space 48 does not serve as CO reduction means and the CO oxidation catalyst member 44 serves as CO reduction means In the low combustion state.

Operations and actions of the working example of the above-described constitution are explained below. Burning-reaction ongoing gas derived from the burner 1 is subjected to a $NO_x$ reduction action, i.e., combustion-gas-temperature suppression actions by the first to fourth suppression means, at the same time, and still also subjected to such constant excess-air-ratio control that $O_2$ (%) is held at 5.8 in the high combustion state and at 6.25 in the low combustion state by the excess-air-ratio control means.

This constant excess-air-ratio control is explained with reference to the drawings. Now it is assumed that with an outside-air temperature of 20° C., the steam boiler is in high-combustion operation. Referring to FIG. 6, the first damper 18 is rotated clockwise by the second electric motor 26, thereby controlled so that the rotational-position restricting plate 30 comes into contact with the tip end of the first adjustment screw 31. Then, the first control circuit 43 determines rotational-position data from the excess-air-ratio correction data of FIG. 8 and the detection temperature by the outside-air temperature sensor 42, i.e., the outside-air temperature of 20° C. In explanation with FIG. 8, rotational-position data "a" at the point "e" is determined, the third electric motor 38 is driven based on this value, the first coupling member 36 is rotated so that the first adjustment screw 31 is rotated, and the rotational position of the first damper 18 is adjusted, thus the control being exerted so that the excess air ratio becomes 5.8% $O_2$.

With the outside-air temperature varied, the rotational position of the first damper 18 is finely adjusted in the same manner so that the specified excess air ratio becomes 5.8% $O_2$.

In the low combustion state, the control circuit 43 controls the fourth electric motor 39 based on a signal from the outside-air temperature sensor 42 and the excess-air-ratio correction data of the curve Y of FIG. 8 to rotate the second coupling member 37 and the second adjustment screw 32, thereby finely adjusting the rotational position of the first damper 18 so that 6.25% $O_2$is obtained.

By such constant excess-air-ratio control, the excess air ratio is under a generally constant excess-air-ratio control at all times even with the outside-air temperature varied, so that the value of $NO_x$ generation is suppressed to 10 ppm. That is, as a result of the combustion-gas-temperature suppression action by the $NO_x$ reduction means, the combustion gas temperature is lowered by about 100° C. on an average, compared with the comparative example in which the actions by the third suppression means and the fourth suppression means are not exerted. As a result, the $NO_x$ value in the combustion gas flowing out from the upstream-side heat transfer tubes 2 is suppressed to about 10 ppm as shown by the curve A and curve E of FIGS. 4 and 5, respectively.

Also, by the foregoing constant excess-air-ratio control, the value of exhaust CO derived from the $NO_x$ reduction means is also controlled to a specified value. The CO value is about 400 ppm in the high combustion state and about 100 ppm in the low combustion state as shown by the characteristic curve B and curve F of FIGS. 4 and 5, respectively.

Next, the reduction of CO is explained. CO generated in the foregoing $NO_x$ reduction step is, first, partly oxidized at the heat-transfer-tube removal space 48 in the high combustion state, and scarcely oxidized in the low combustion state, then reaching the exhaust gas outlet 16 as exhaust gas. CO remaining in this exhaust gas is oxidized by the CO oxidation catalyst member 44 so that the CO value is reduced to about 1/10, as shown by the characteristic curve M and curve N of FIGS. 4 and 5.

According to this working example, the following working effects are produced. Since the excess air ratio is controlled to a generally constant high excess air ratio by the excess-air-ratio control means, a stable $NO_x$ reduction effect can be obtained even with outside air temperature varied. As a result, the $NO_x$ reduction target value can be met over a wide range of operating points on the day and year bases. Also, since the constant excess-air-ratio control is performed in the light of the relationship between outside-air temperature and excess air ratio, which is the greatest factor of variations of $NO_x$ value, the control equipment becomes quite simple in constitution, compared with the case where the control is performed in consideration of variation factors other than the outside-air temperature. Besides, the outside-air temperature sensor is more stable in performance, longer in life and lower in price, compared with oxygen concentration detection sensors, so that a practical combustion apparatus for $NO_x$ reduction can be provided.

Further, the exhaust CO value from the $NO_x$ reduction means is also controlled to a constant one by the constant excess-air-ratio control. As a result, the possibility that the exhaust CO value increases due to changes in excess air ratio beyond the processing capacity of the CO oxidation catalyst member 44 is eliminated, thus producing an effect that a stable CO reduction can be achieved. In particular, for a $NO_x$ reduction means of which the $NO_x$ reduction target value is not more than 10 ppm, involving an abrupt increase of the exhaust CO value at around 10 ppm, the constant excess-air-ratio control produces quite a large effect in terms of the achievement of a CO reduction target value and the facilitation of the capacity design of the CO oxidation catalyst member 44.

The facilitation of the capacity design of the CO oxidation catalyst member 44 is further explained. The CO oxidation catalyst member 44, in which pressure loss increases with increasing capacity, is so designed that the CO reduction target value can be satisfied just at the very limit. Without the constant excess-air-ratio control, there would arise a need for designing the processing capacity of the CO oxidation catalyst member 44 with a margin. Meanwhile, with the processing capacity increased, the pressure loss would increase. As a result, the pressure loss of the steam boiler itself would increase, giving rise to a need for redesigning the blower 4 or the boiler body 3. Performing the constant excess-air-ratio control, as in this working example, has an effect of solving these problems.

Further, according to this working example, both the $NO_x$ reduction for reducing the generated $NO_x$ value to not more than 10 ppm as well as the CO reduction can be achieved at the same time, greatly contributing to air pollution control. Besides, in the low combustion state, although the heat-transfer-tube removal space 48 does not function effectively as CO reduction means, yet CO is oxidized by the CO oxidation catalyst member 44, so that CO reduction can be fulfilled regardless of whether it is in the high combustion state or the low combustion state.

Figure 10:
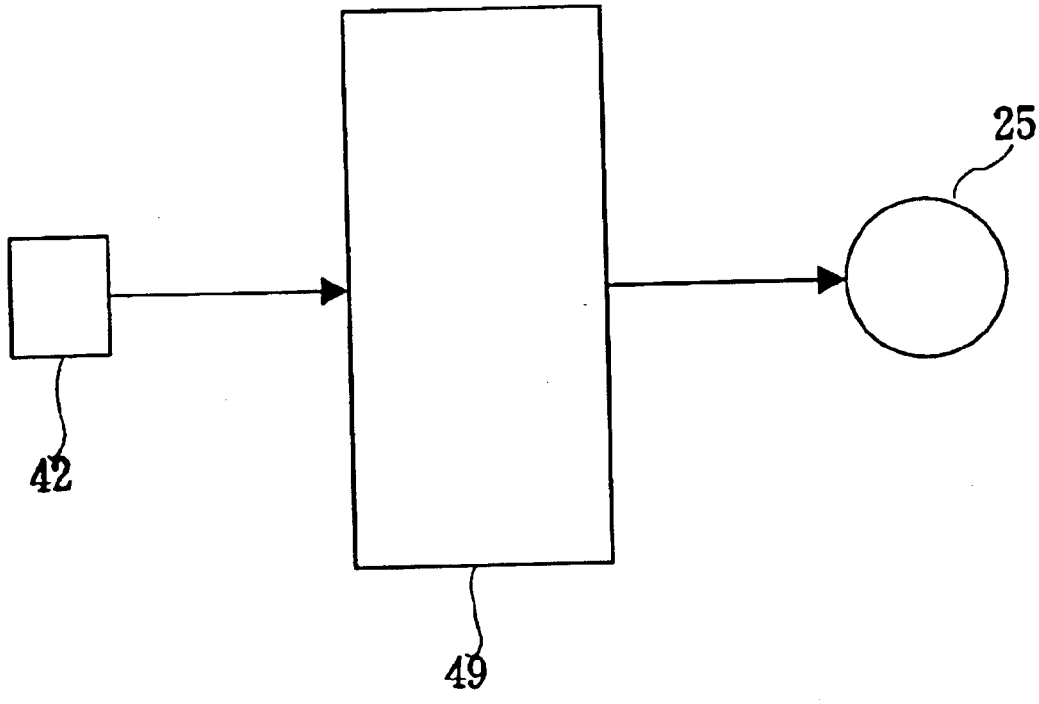
FIG. 10 is a main-part control circuit diagram of another embodiment of the present invention.
Figure 11:
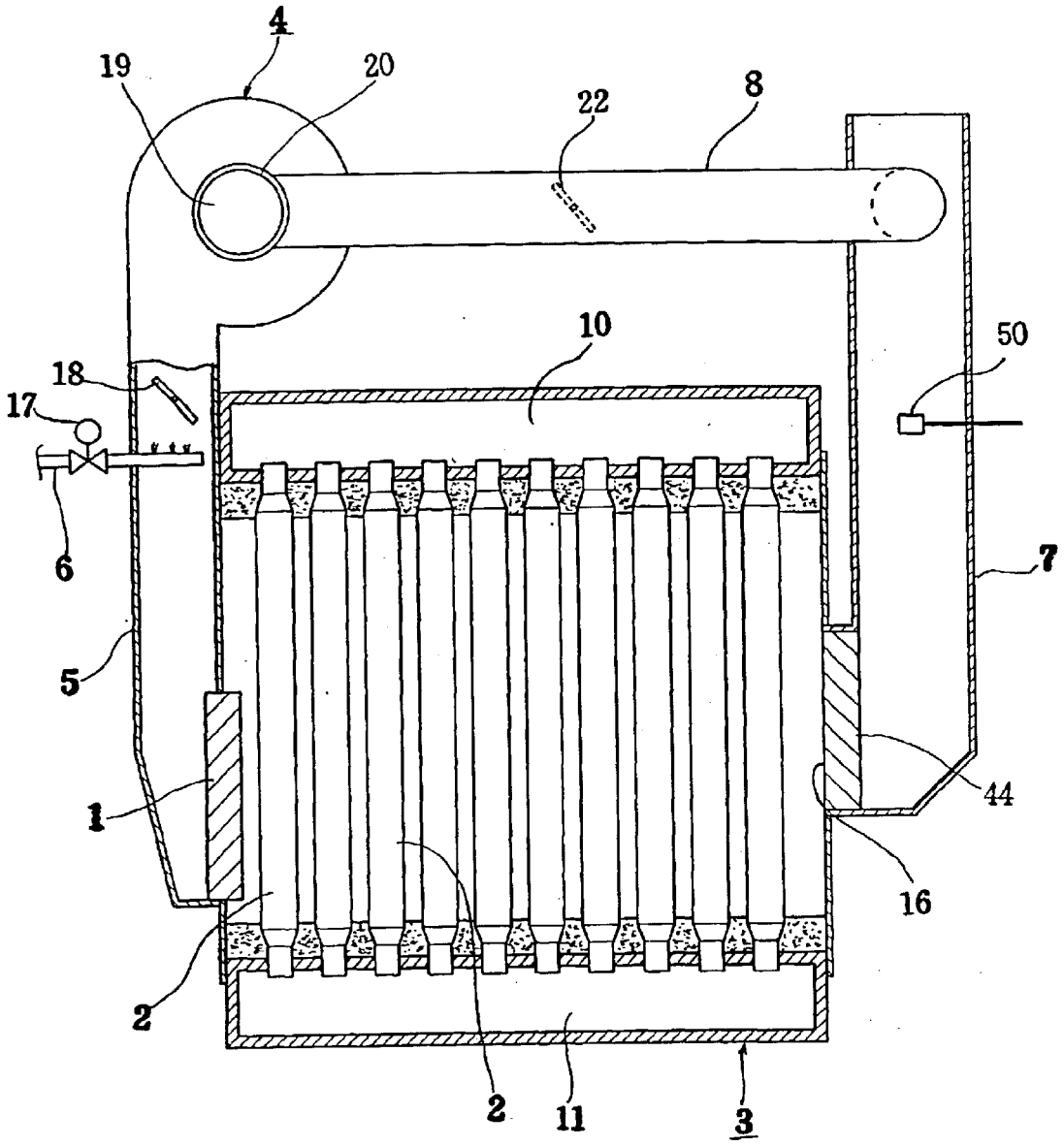
FIG. 11 is an explanatory view of a longitudinal section of another embodiment of the present invention.

It is noted that the present invention is not limited to the above-described working example, and includes the following modifications. Although the excess-air-ratio control means is controlled by the first damper 18 in the foregoing working example, the rotational speed of the blower 4 may also be controlled in another embodiment. In this case, the first electric motor 25 is provided by one that is inverter-controllable. Then, the relationship between outside-air temperature and excess air ratio is preliminarily determined by experiments at a specified combustion quantity and a specified exhaust-gas recirculation quantity, by which an excess-air-ratio correction table on the outside-air temperature versus blower rotational speed basis is prepared. With this correction table preliminarily stored in memory (not shown) of a control circuit 49 as shown in FIG. 10, the electric motor 25 for the blower 4 may be controlled based on the correction table so that the excess air ratio becomes generally constant.

Also, the first suppression means is provided as a fully-premixing type burner in the above working example, but it may also be provided as a partially-premixing type burner in another embodiment.

Also, although the heat transfer tubes 2 of the second suppression means are implemented by vertical water tubes in the foregoing working example, yet the heat transfer tubes 2 may also be implemented by water tubes which are positioned horizontal or tilted. Further, the shape of the heat transfer tubes 2 is also not limited to a perfect circle of the foregoing working example, and may be shaped into elliptical or other shapes in another embodiment.

Also, the heat transfer tubes 2 of the second suppression means are provided as bare tubes in the foregoing working example. However, it is also possible that some of the heat transfer tubes 2 in the downstream of the heat-transfer-tube removal space 48 may be fitted with horizontal fillet-like fins or full-peripheral fins (not shown either) so that the heat recovery rate can be enhanced, depending on embodiment.

Figure 12:
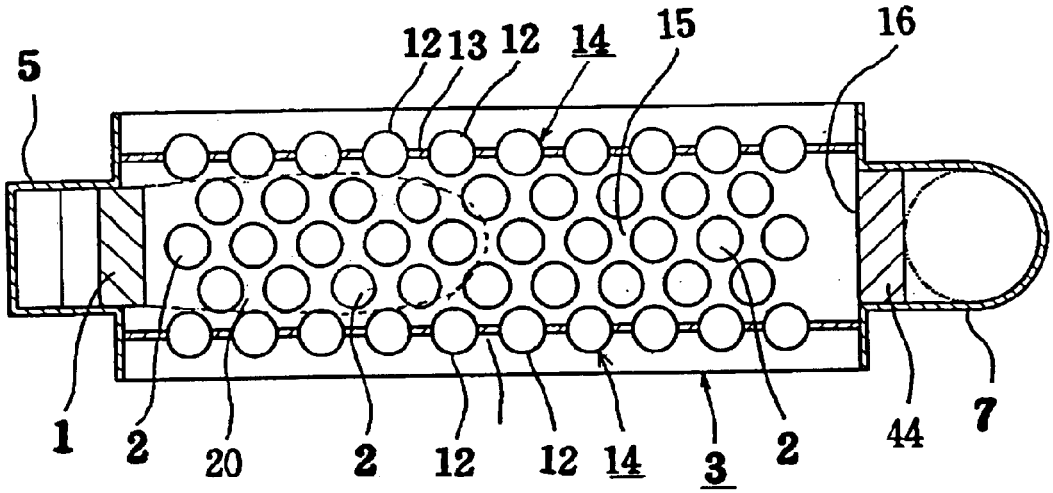
FIG. 12 is a sectional explanatory view of another embodiment of the present invention, corresponding to FIG. 2.

Also, the heat-transfer-tube removal space 48 is included in the $NO_x$ reduction means in the foregoing working example. Otherwise, in another embodiment, it is also possible that the heat-transfer-tube removal space 48 is omitted, i.e., none of the heat transfer tubes are removed, as shown in FIG. 12.

Also, the steam boiler of the foregoing working example is switchable between combustion quantities of high combustion and low combustion. However, the steam boiler may also be a steam boiler without the switching of combustion quantity, in another embodiment.

Further, the CO oxidation catalyst member 44 is attached at the exhaust gas outlet 16 in the foregoing working example. However, in the case where a feed water preheater (economizer) (not shown) is provided on the exhaust gas passage 7, the CO oxidation catalyst member 44 may also be disposed on the upstream side of the feed water preheater in the chamber in which the feed water preheater is contained.

According to the present invention, there are provided advantages such as the capability of fulfilling stable $NO_x$ reduction and CO, reduction even with the outside-air temperature varied, thus the invention being of great industrial value.

What is claimed is:

1. A combustion apparatus for $NO_x$ reduction by suppressing temperature of combustion gas derived from a burner, comprising:

$NO_x$ reduction means having an excess air ratio versus $NO_x$ characteristic that generated $NO_x$ value decreases with increasing excess air ratio of the burner, and an excess air ratio versus CO characteristic that exhaust CO value increases with increasing excess air ratio; and excess-air-ratio control means for controlling the excess air ratio of the burner to a specified excess air ratio, wherein the excess-air-ratio control means includes outside-air temperature detection means and controls the excess air ratio to the specified excess air ratio based on a detection signal derived from the outside-air temperature detection means.

2. A combustion apparatus for $NO_x$ reduction as claimed in claim 1, wherein the excess-air-ratio control means includes combustion-use-air flow rate adjusting means provided on an air supply passage and serving for feeding combustion-use air to the burner, and the combustion-use-air flow rate adjusting means controls an opening of the combustion-use-air flow rate adjusting means based on a detection signal derived from the outside-air temperature detection means, thereby fulfilling the control to the specified excess air ratio.

3. A combustion apparatus for $NO_x$ reduction as claimed in claim 2, wherein the combustion-use-air flow rate adjusting means includes: a damper; positioning means for determining rotational position of the damper; and fine adjustment means for acting on the positioning means to finely adjust the rotational position of the damper in response to a detected temperature of the outside-air temperature detection means.

4. A combustion apparatus for $NO_x$ reduction as claimed in claim 1, wherein the excess-air-ratio control means controls rotational speed of a blower, which feeds combustion-use air to the burner, based on a detection signal derived from the outside-air temperature detection means, thereby fulfilling the control to the specified excess air ratio.

* * * * *